United States Patent [19]

Hanson

[11] 4,078,561

[45] Mar. 14, 1978

[54] AIR SUPPLIED EMERGENCY HELMET

[75] Inventor: Harold R. Hanson, Appleton, Wis.

[73] Assignee: The Raymond Lee Organization, Inc., New York, N.Y.

[21] Appl. No.: 695,949

[22] Filed: Jun. 14, 1976

[51] Int. Cl.[2] ..... A62B 7/00

[52] U.S. Cl. ..... 128/142.7

[58] Field of Search ..... 128/142.7, 142.5, 147, 128/145 R

[56] References Cited

U.S. PATENT DOCUMENTS

| | | | |
|---|---|---|---|
| 1,201,566 | 10/1916 | Davidson | 128/142.7 |
| 3,562,813 | 2/1971 | Origer | 128/142.7 |
| 3,976,063 | 8/1976 | Henneman et al. | 128/142.7 |

FOREIGN PATENT DOCUMENTS

| | | | |
|---|---|---|---|
| 324,415 | 2/1935 | Italy | 128/142.7 |

*Primary Examiner*—John D. Yasko
*Assistant Examiner*—Henry J. Recla
*Attorney, Agent, or Firm*—Howard I. Podell

[57] ABSTRACT

A helmet for emergency fire use fitted with air supply means supported at the forward section of the helmet that is led to the user through a mouthpiece from a container of pressurized air. The mouthpiece, when gripped by the user, for breathing purposes, serves as a structural support of the worn helmet.

1 Claim, 2 Drawing Figures

AIR SUPPLIED EMERGENCY HELMET

SUMMARY OF THE INVENTION

My invention is a helmet for emergency fire use fitted with air supply means supported at the forward section of the helmet that is led to the user through a mouthpiece from a container of pressurized air. The mouthpiece, when gripped by the user, for breathing purposes, serves as a structural support of the worn helmet.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
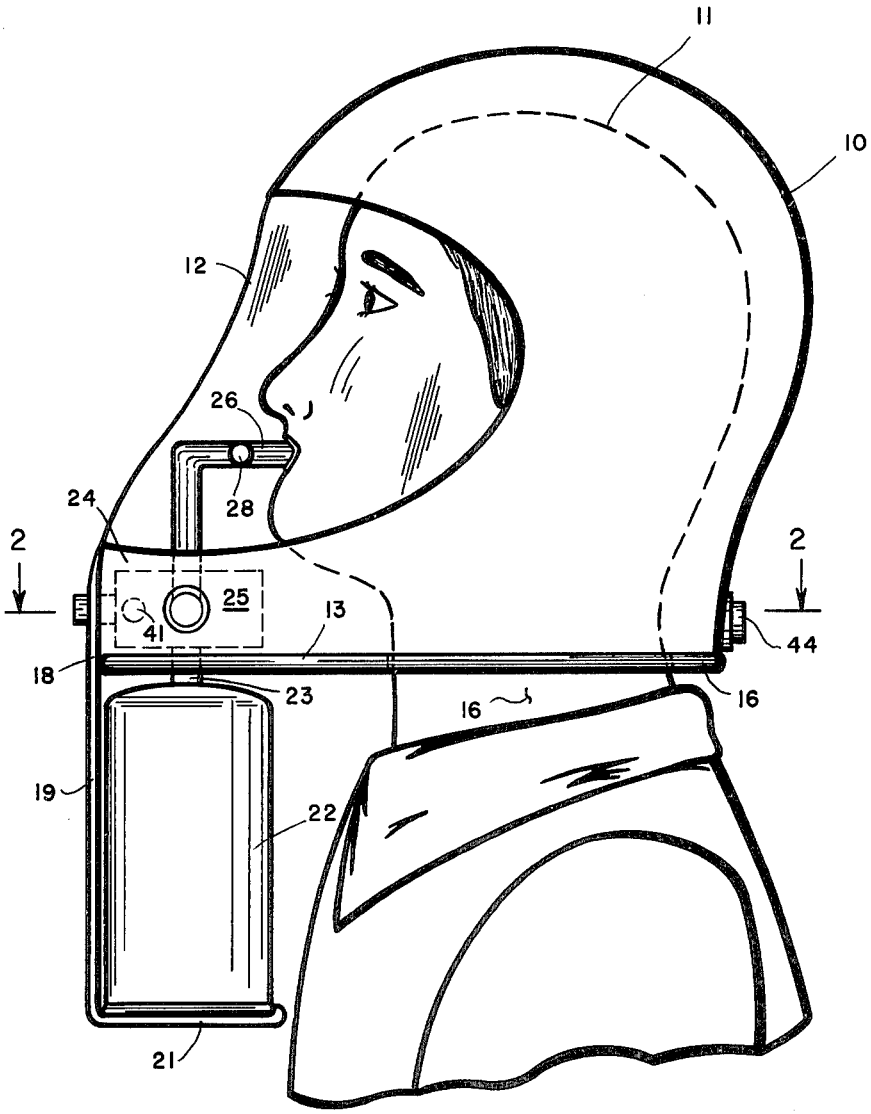
FIG. 1 is a side view of the invention in use.
Figure 2:
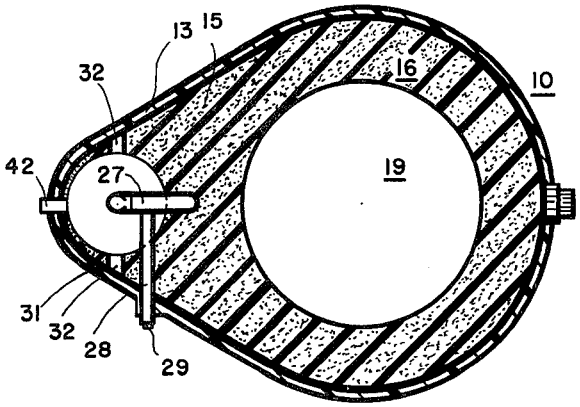
FIG. 2 is a sectional view of the invention, taken along line 2—2 of FIG. 1.

Turning now descriptively to the drawings, in which similar reference characters denote similar elements throughout the several views, FIGS. 1-2 illustrate helmet 10 which is formed of a semi-rigid material of a shape to enclose the head 11 of a wearer and formed with a transparent section 12 located in the formed section of the helmet 10. A rim 13 is formed about the circumference of the helmet opening 15 and a flexible circular collar 16 is fitted internally into the opening 15 to form a circular opening 19 of a size to snugly grip the neck 16 of the wearer, with collar 16 mounted to the internal periphery of the helmet opening. The lower front portion 18 of the helmet extends forward of collar 16 to join a shield unit 19 extending below the forward helmet portion 18. Shield unit 19 forms a shelf 21 on which a can 22 of pressurized air may be mounted below the forward helmet portion 18. Shield unit 19 forms a shelf 21 on which a can 22 of pressurized air may be mounted below the forward portion of helmet 10, with the tube outlet 23 of can 22 extending through collar 16 into the forward interior section 24 of the helmet, to join a flow regulator unit 25 controlled by the inhalation of the user through mouthpiece 26 attached to the intake outlet 27 of regulator unit 25. An exhaust outlet 28 is led from intake outlet 22 through the helmet wall 31 to an exhaust valved opening 29. Regulator unit 25 is externally fastened by braces 32 to the wall 31 of the helmet.

A purge valve 41 operated by a push button 42 that projects externally through helmet wall 31 serves to admit air from regulator 25 into the interior of the helmet for emergency use in blowing any smoke out of the helmet through an exhaust valve 44 mounted in the rear helmet wall, but in normal use, air from can 22 is led through regulator 25 to mouthpiece 26 which is gripped by the user to support the weight of the helmet 10. Exhaust air from breathing is led out of the helmet through exhaust tube 28 to maintain the interior transparent surface 12 free of fogging.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the U.S. is:

1. A helmet for emergency use internally fitted with a flexible collar surrounding the rim of the helmet opening, said collar including a neck opening of a size to grip the neck of a user, when worn, so as to seal the interior of the helmet, together with air supply means externally mounted to the forward section of the helmet below the said flexible collar, a mouthpiece connected to said air supply means and extending within said helmet adjacent the front portion thereof which serves as a structural support for the helmet, when worn, in which the air supply means comprises a container of pressurized air externally, a support member extending from the forward section of the helmet below the helmet, said container being mounted on said support member, a regulator unit in the helmet connected between said mouthpiece and said container whereby so that the user, in gripping the mouthpiece, supports the weight of the container.

* * * * *